US009987845B2

(12) United States Patent
Dowell

(10) Patent No.: US 9,987,845 B2
(45) Date of Patent: Jun. 5, 2018

(54) PRINTHEAD ASSEMBLY MODULE

(71) Applicant: HEWLETT-PACKARD DEVELOPMENT COMPANY, L.P., Houston, TX (US)

(72) Inventor: Daniel D Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/311,772

(22) PCT Filed: May 30, 2014

(86) PCT No.: PCT/US2014/040264

§ 371 (c)(1),
(2) Date: Nov. 16, 2016

(87) PCT Pub. No.: WO2015/183309

PCT Pub. Date: Dec. 3, 2015

(65) Prior Publication Data

US 2017/0096004 A1 Apr. 6, 2017

(51) Int. Cl.
*B41J 2/14* (2006.01)
*B41J 2/16* (2006.01)

(52) U.S. Cl.
CPC .... *B41J 2/1433* (2013.01); *B41J 2002/14419* (2013.01)

(58) Field of Classification Search
None
See application file for complete search history.

(56) References Cited

U.S. PATENT DOCUMENTS

| | | | |
|---|---|---|---|
| 5,160,945 | A | 11/1992 | Drake |
| 5,565,900 | A | 10/1996 | Cowger et al. |
| 6,250,738 | B1 | 6/2001 | Waller |
| 6,350,013 | B1 | 2/2002 | Scheffelin et al. |
| 6,450,614 | B1 | 9/2002 | Scheffelin et al. |
| 6,543,880 | B1 | 4/2003 | Akhavain et al. |
| 6,557,976 | B2 | 5/2003 | McElfresh et al. |
| 6,592,200 | B2 | 7/2003 | Wotton et al. |
| 6,726,298 | B2 | 4/2004 | Anderaqn et al. |
| 7,226,156 | B2 | 6/2007 | Boyd et al. |
| 8,672,433 | B2 | 3/2014 | Kusakari |
| 2002/0167565 | A1 | 11/2002 | Maeda et al. |
| 2003/0137554 | A1 | 7/2003 | Silverbrook et al. |
| 2004/0085394 | A1 | 5/2004 | Martin et al. |
| 2004/0113996 | A1 | 6/2004 | Boyd et al. |

(Continued)

FOREIGN PATENT DOCUMENTS

| | | |
|---|---|---|
| DE | 19743804 | 4/1999 |
| EP | 0568247 | 11/1993 |

(Continued)

*Primary Examiner* — Erica Lin
(74) *Attorney, Agent, or Firm* — HP Inc. Patent Department

(57) ABSTRACT

In one example, a printhead assembly module includes an upstream row of printheads and a downstream row of printheads. The upstream and downstream rows of printheads are offset from one another such that a printhead in the upstream row extends past the downstream row at one end of the module and a printhead in the downstream row extends past the upstream row at the other end of the module.

5 Claims, 8 Drawing Sheets

(56) References Cited

U.S. PATENT DOCUMENTS

| | | | | |
|---|---|---|---|---|
| 2005/0012780 | A1 | 1/2005 | Gil | |
| 2005/0200669 | A1 | 9/2005 | Timm et al. | |
| 2006/0103691 | A1 | 5/2006 | Dietl et al. | |
| 2007/0046739 | A1 | 3/2007 | Lee et al. | |
| 2010/0289852 | A1 | 11/2010 | Woolfe et al. | |
| 2012/0038709 | A1* | 2/2012 | Owaki ..... | B41J 2/17513 347/40 |
| 2013/0201255 | A1 | 8/2013 | Dowell et al. | |

FOREIGN PATENT DOCUMENTS

| | | |
|---|---|---|
| EP | 1186416 | 3/2002 |
| JP | 2002-086742 | 3/2002 |
| JP | 2012-040702 | 3/2012 |
| WO | WO2012/166112 | 12/2012 |
| WO | WO2012166112 | 12/2012 |

* cited by examiner

PRINTHEAD ASSEMBLY MODULE

BACKGROUND

In some inkjet printers, a stationary media wide printhead assembly, commonly called a print bar, is used to print on paper or other print media moving past the print bar.

DRAWINGS

The same part numbers are used to designate the same or similar parts throughout the figures.

DESCRIPTION

Figure 1:
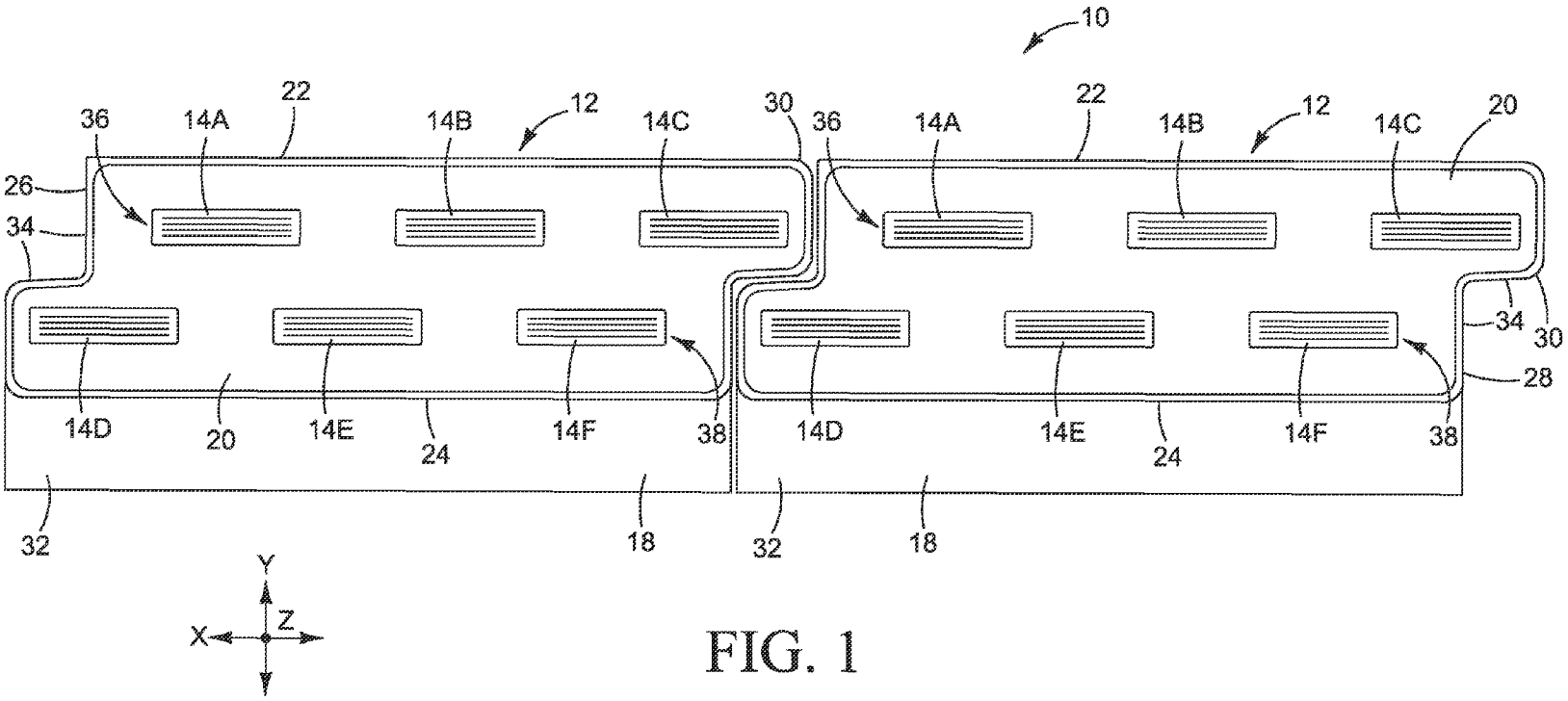
FIG. 1 is a bottom side plan view illustrating one example of a modular print bar.

Media wide print bars for inkjet printers must meet precise dimensional requirements to maintain the appropriate position and spacing during printing. Scaling print bars to print on wider media, for example to span B, C, D or even E size media sheets, presents special challenges for cost-effective manufacturing and high performance. For example, dimensional tolerances such as size, position and flatness for the cast or molded parts in chassis and flow structure increase with length while the dimensional requirements for the assembled parts are the same regardless of length. For another example, the reliability requirements for a wider print bar will usually be more stringent than for a narrower print bar due to the greater number of printheads and other parts that can fail, as well as the greater cost to reject a defective print bar at the factory or to replace a defective print bar in a printer.

A new modular print bar has been developed to help meet the challenges of scaling print bars up to print on wider media. In one example, the new print bar includes multiple interchangeable printhead assembly modules stacked end to end with a part of each module overlapping a part of an adjacent module. Each module may include, for example, two rows of printheads in a staggered configuration where one printhead in each row extends into the overlap between modules for seamless printing across the full span of the print bar. A modular print bar allows narrower individual printhead assemblies, half the width of an A-size page for example, reducing the length and corresponding dimensional tolerances of the chassis and flow distribution parts. Also, the use of narrower printhead assemblies helps moderate reliability requirements for a wider print bar by limiting reliability primarily to the narrower individual assemblies.

Unfortunately, the external shape of a stackable module with the desired overlap presents spatial problems for the flow distribution parts supported in or on the chassis. For example, notching the ends of the chassis to enable stacking reduces the space available at each end for routing printing fluid to the printheads, eliminating the repeating geometric flow blocks used in earlier monolithic bars as a viable option for the new modular print bar. Accordingly, a new fluid flow structure has been developed to help effectively implement the notched modules. In one example, the new flow structure includes slots to carry printing fluid to the printheads and corresponding channels to distribute printing fluid to the slots. The slots and channels are arranged on one or more plates so that the arrangement is the same when rotated 180° about an axis of symmetry located at the geometric center of the arrangement. The symmetrical arrangement of the channels and slots allows the same fluid flow "solution" on both ends of the notched, stackable module. Also, the channels may be formed in different levels in multiple plates to further shrink the footprint of the fluid flow structure.

These and other examples shown in the figures and described herein are non-limiting examples. Other examples are possible and nothing in this Description should be construed to limit the scope of the invention which is defined in the Claims that follow the Description.

As used in this document, "printhead" and "print bar" are not limited to printing with ink but also include inkjet type dispensing of other fluids and/or for uses other than printing; "stack" means things arranged one next to another or one upon another; and "upstream", "downstream", "top", "bottom" and other terms of orientation or direction are determined with reference to the usual orientation of a print bar when installed in printer for printing in which the printheads face vertically downward.

Figure 2:
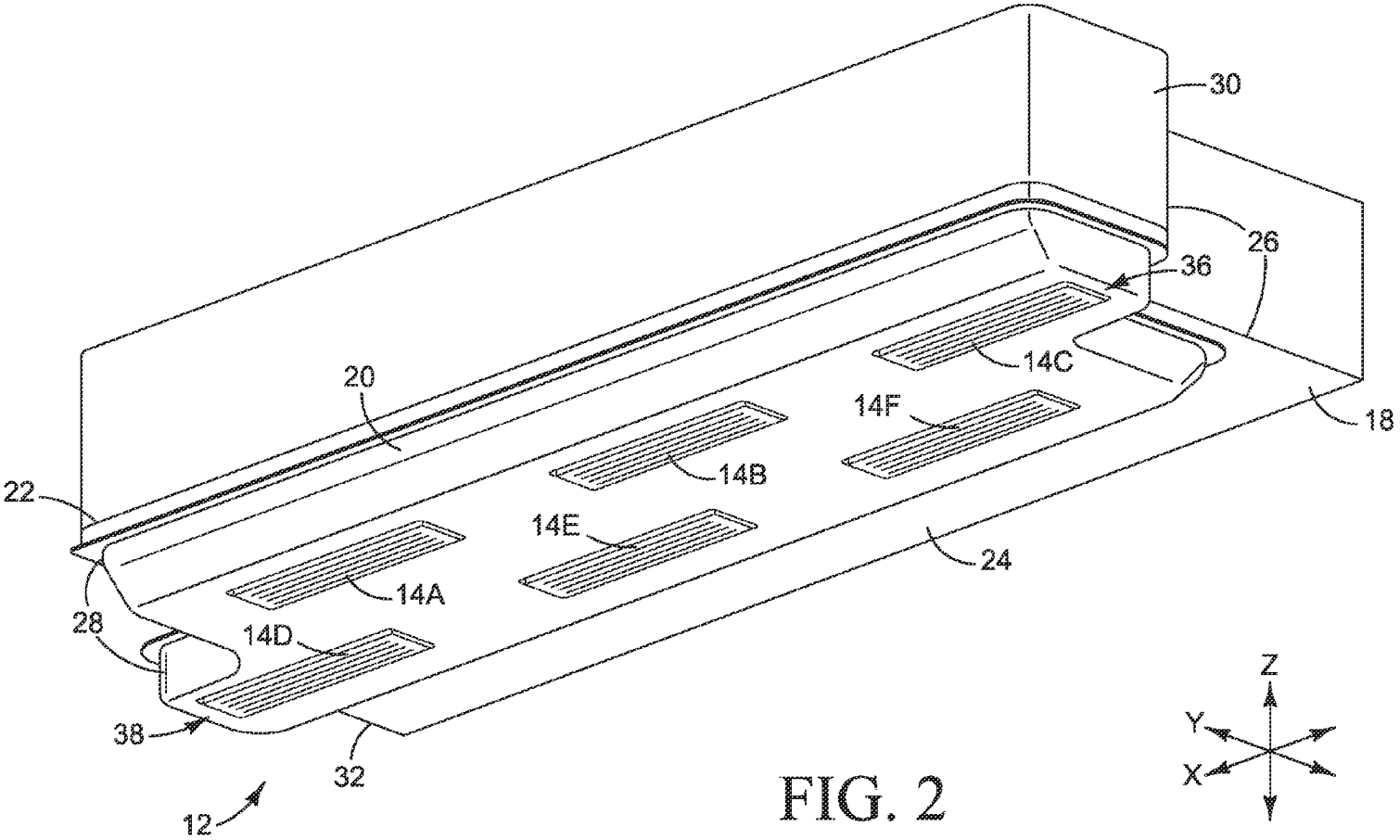
FIGS. 2 and 3 are bottom side and top side perspectives, respectively, illustrating one example of a printhead assembly module such as might be used in the print bar of FIG. 1.
Figure 3:
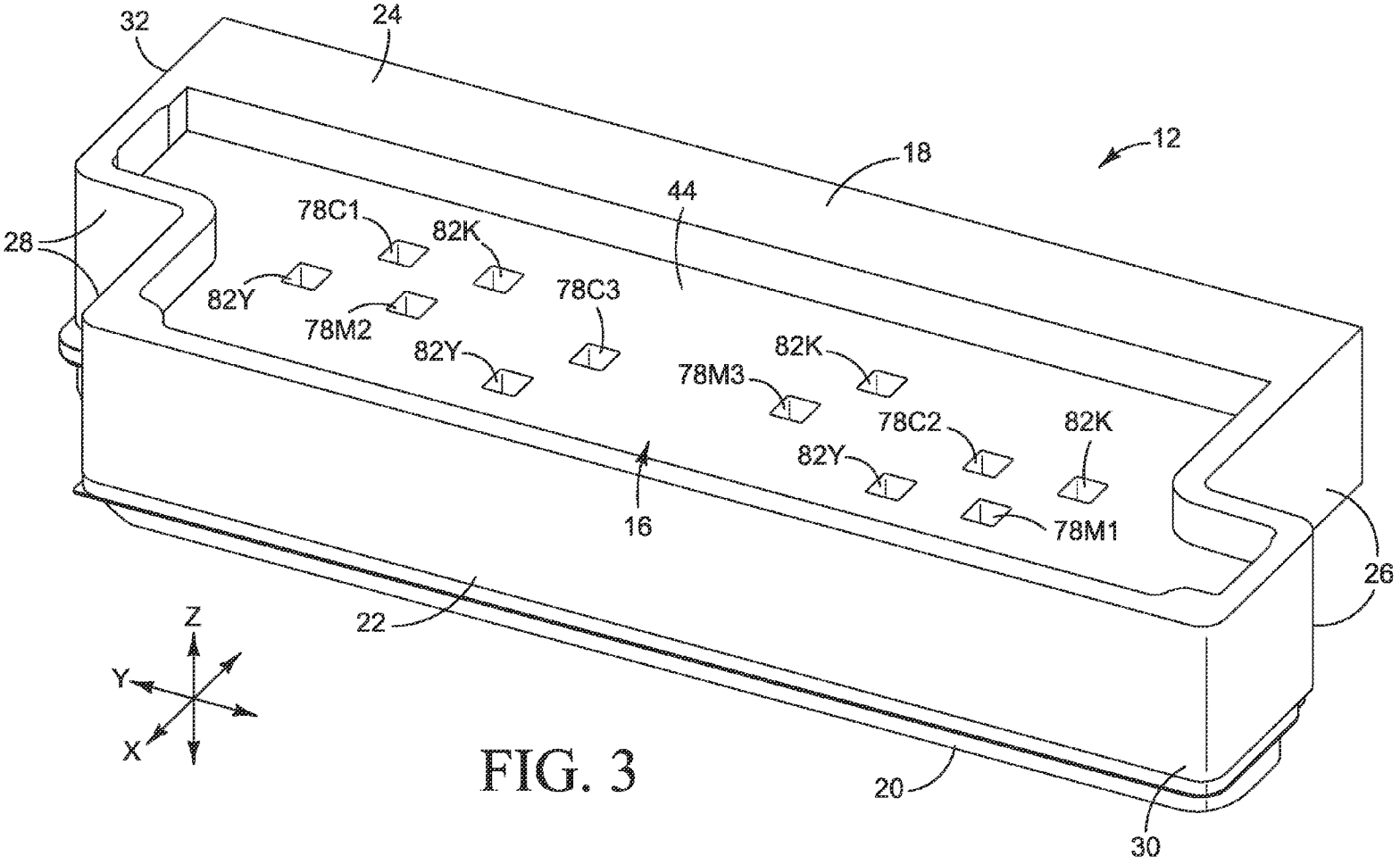
Figure 4:
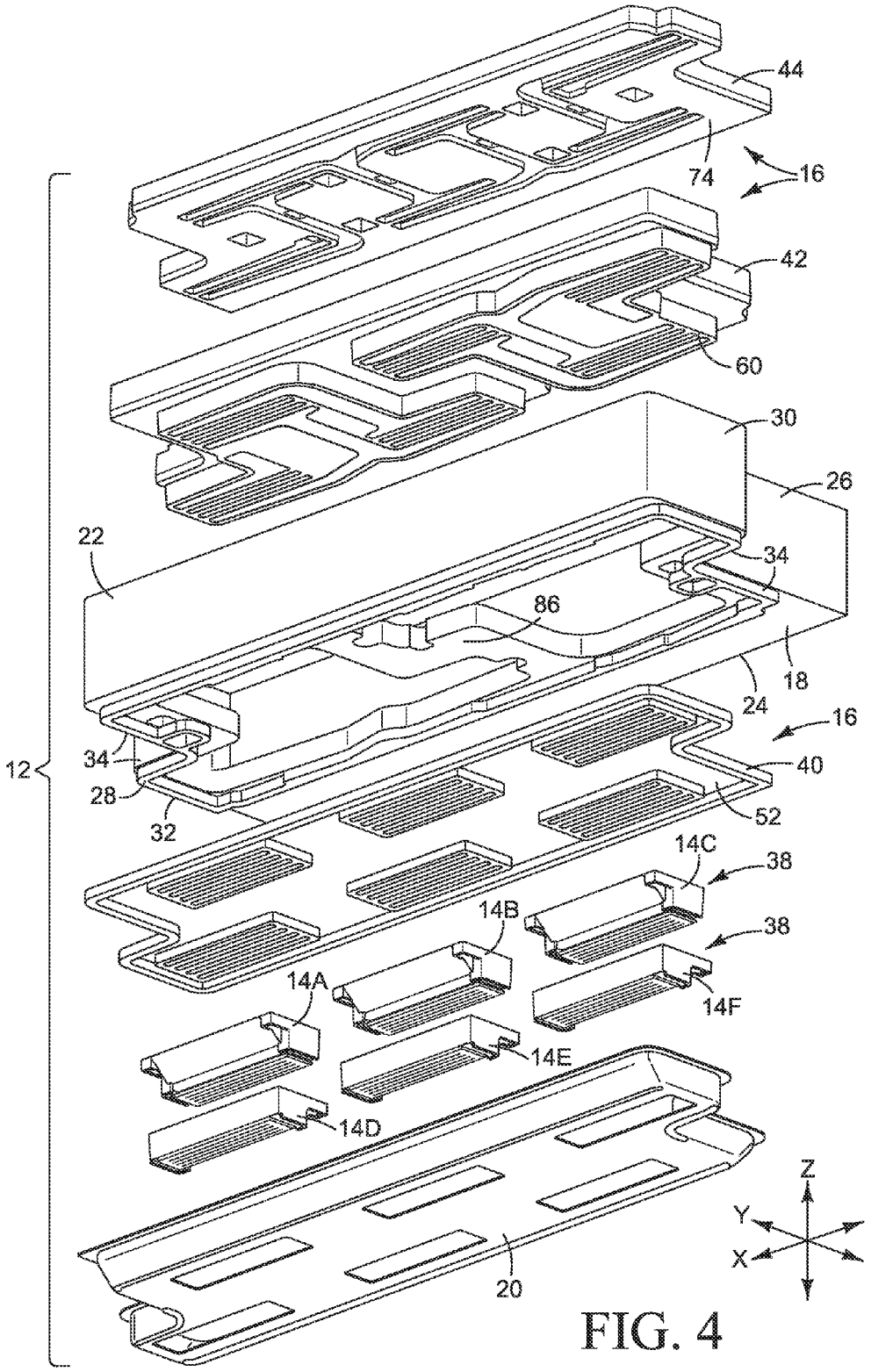
FIG. 4 is an exploded perspective of the printhead assembly module shown in FIGS. 2 and 3.

FIG. 1 is a bottom side plan view illustrating one example of a modular print bar 10 that includes two interchangeable printhead assembly modules 12 stacked end to end with a protruding end of one module overlapping a protruding end of the adjacent module. FIGS. 2 and 3 are bottom side and top side perspectives, respectively, illustrating one example of a printhead assembly module 12 such as might be used in print bar 10 shown in FIG. 1. FIG. 4 is an exploded perspective of printhead assembly module 12 shown in FIGS. 2 and 3. Referring to FIGS. 1-4, each printhead assembly module 12 includes printheads 14A-14F and a multi-part printing fluid flow structure 16 supported by a chassis 18. Module 12 also includes a shroud 20 surrounding printheads 14A-14F and covering the underlying parts. In addition to supporting printheads 14A-14F and flow structure 16, chassis 18 usually will provide structural support and reference surfaces for accurately mounting module 12 in a printer as part of a modular print bar 10, for example as part of a media wide print bar. Although two modules 12 each with six printheads 14A-14F in a staggered arrangement are shown in FIG. 1, other print bar and module configurations are possible. For example, more modules with more or fewer printheads could be used and with the printheads arranged differently from that shown.

Printheads 14A-14F are arranged in two rows—printheads 14A-14C are aligned across the upstream part 22 of chassis 18 in the X direction and printheads 14D-14F are aligned across the downstream part 24 of chassis 18 in the X direction. As noted above, "upstream" and "downstream" and other such references to orientation and direction are taken with respect to the usual position of a module 12 when it is installed in a printer and the printer is ready for printing—the printer will be oriented so the print media moves horizontally past the print bar and ink or other printing fluid is dispensed vertically downward from the print bar on to the media. X, Y, Z axes are noted on each of the figures to help clearly and consistently depict orientation among the different views. The Y axis, or the Y "direction" as it is sometimes called, shows the direction print media usually would move past the printhead assembly module. The X axis, or X "direction" as it is sometimes called, is perpendicular to the media direction and is usually aligned with the print bar. That is to say, the print bar is usually aligned perpendicular to the media direction, although skewing the print bar to the media direction may be possible in some implementations. The Z axis, or Z direction as it is sometimes called, is perpendicular to the X and Y directions and is aligned with the direction printing fluid is usually dispensed from the print bar.

Referring to FIGS. 2-4, the upstream and downstream parts 22, 24 of chassis 18 are offset from one another in the X direction to form notched ends 26, 28. In the example shown, each notched end 26, 28 is defined by a protruding part 30, 32 of each chassis part 22, 24, respectively, and a notch 34. Printheads 14A-14C in upstream row 36 are offset from printheads 14D-14F in downstream row 38 in the X direction in a staggered configuration in which each printhead in one row 36, 38 overlaps a printhead in the other row 36, 38 for seamless printing across module 12, and so that a printhead 14C in upstream row 36 extends past the downstream part 24 of chassis 18 at one end 26 and a printhead 14D in downstream row 38 extends past the upstream part 22 of chassis 18 at the other end 28.

As shown in FIG. 1, the upstream row 36 of printheads 14A-14C in each module 12 is aligned with the upstream row of printheads in the other module in the X direction and the downstream row 38 of printheads 14D-14F in each module 12 is aligned with the downstream row of printheads in the other module in the X direction. Also, the protruding ends 30, 32 of each module overlap so that printheads 14C and 14D for seamless printing across print bar 10. Each module 12 is identical to and thus interchangeable with every other module 12.

Figure 5:
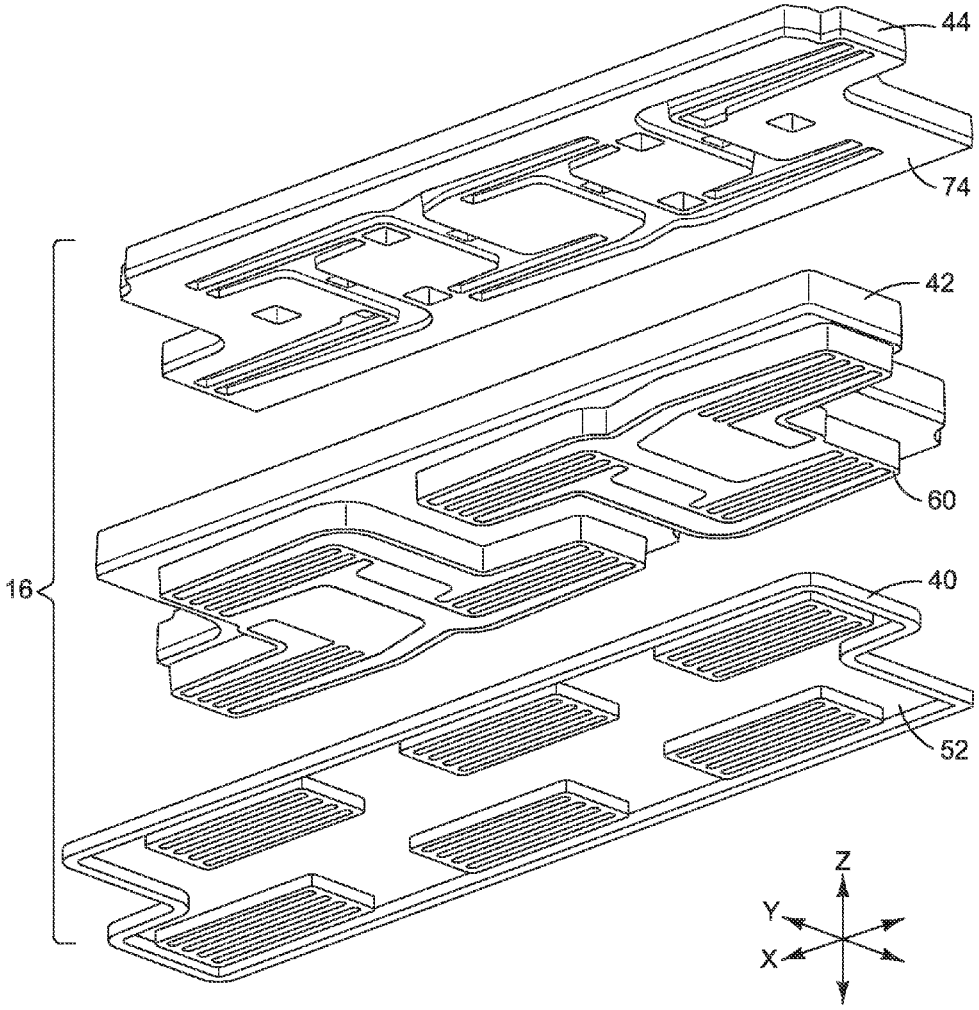
FIG. 5 is a close up exploded perspective of the printing fluid flow structure in the printhead assembly module shown in FIG. 4.

FIG. 5 is a close up exploded perspective of flow structure 16 in the printhead assembly module 12 shown in FIG. 4. Referring to FIGS. 4 and 5, in the example shown, flow structure 16 includes three parts—a bottom plate 40, a middle plate 42, and a top plate 44. Printheads 14A-14F are attached to bottom plate 40, as shown in FIG. 4. As described in detail below, printing fluid flows to each printhead 14A-14F through corresponding slots in bottom plate 40. In the example shown, four groups of slots deliver four printing fluids to each printhead 14A-14F.

Figure 8:
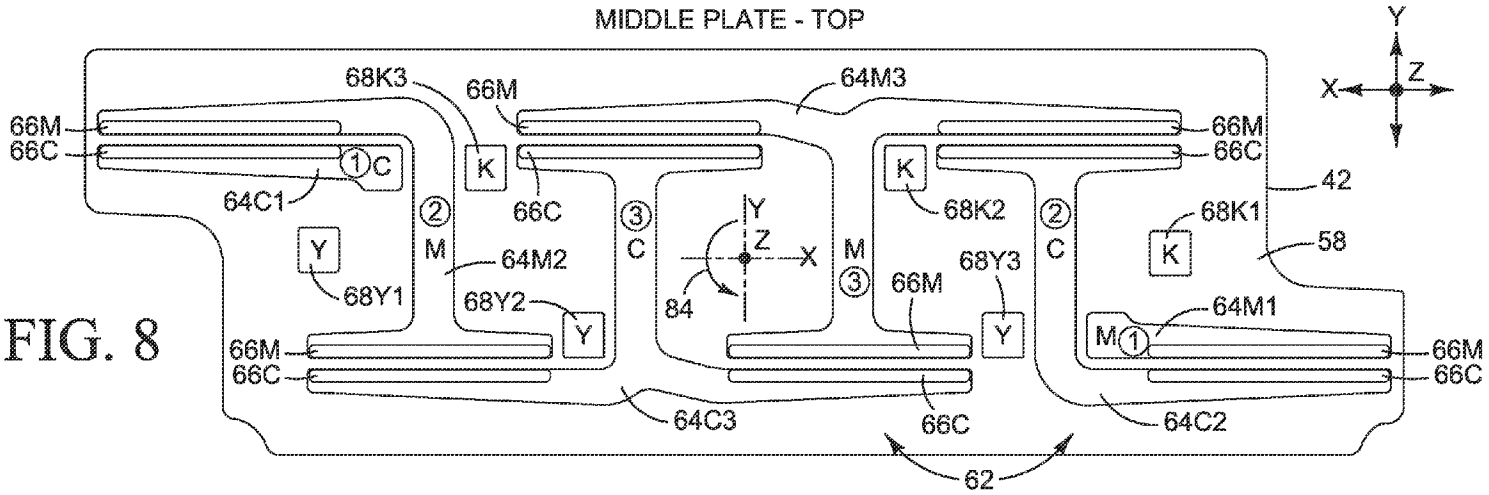
FIGS. 8 and 9 are top and bottom plan views, respectively, of the middle plate in the printing fluid flow structure shown in FIG. 5.
Figure 9:
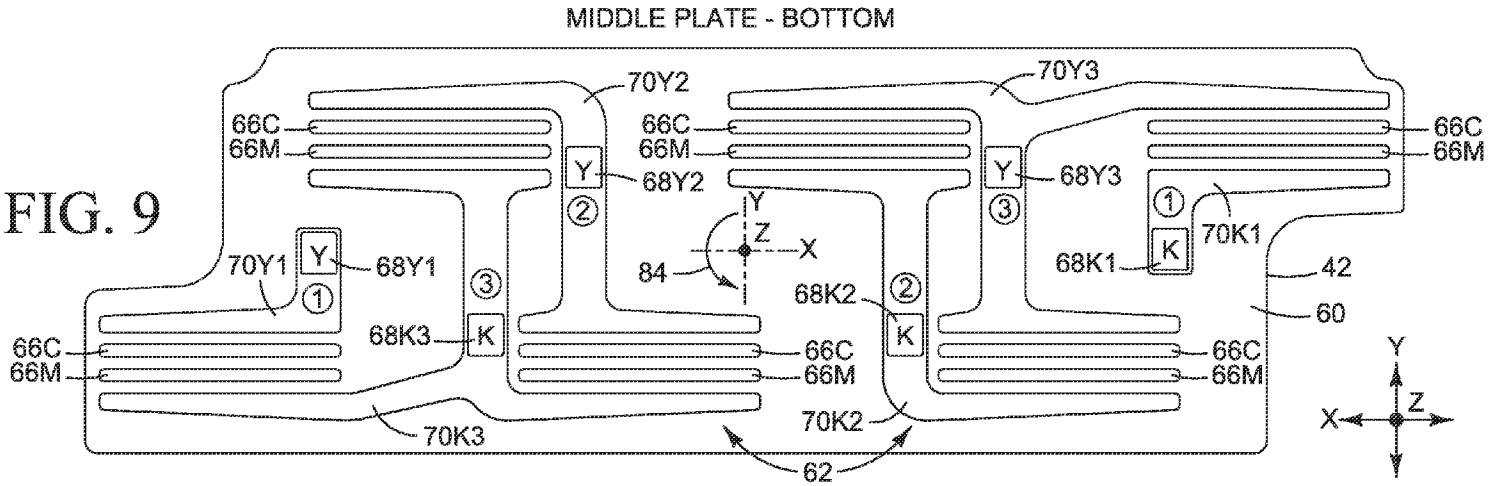
Figure 10:
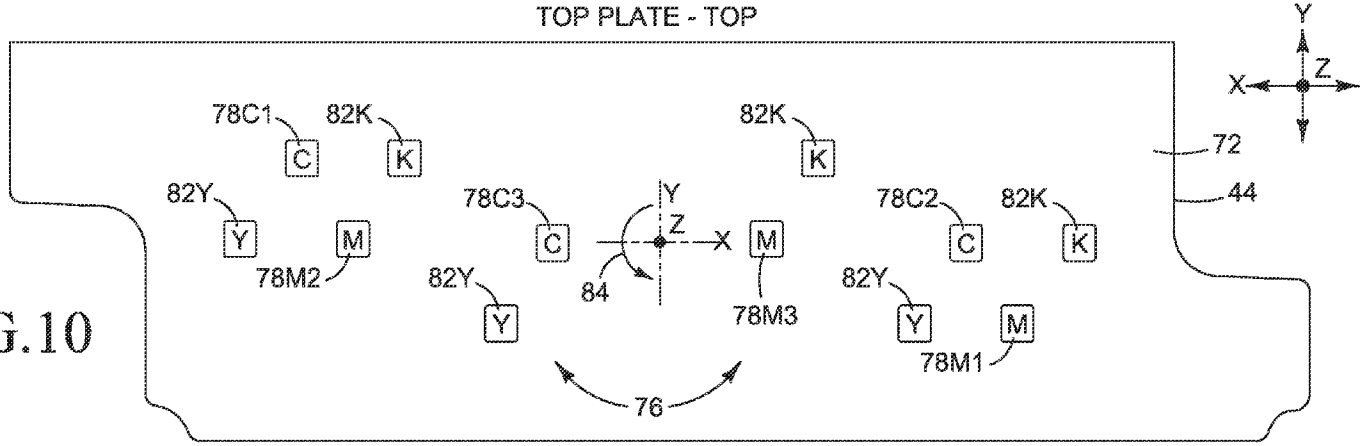
FIGS. 10 and 11 are top and bottom plan views, respectively, of the top plate in the printing fluid flow structure shown in FIG. 5.
Figure 11:
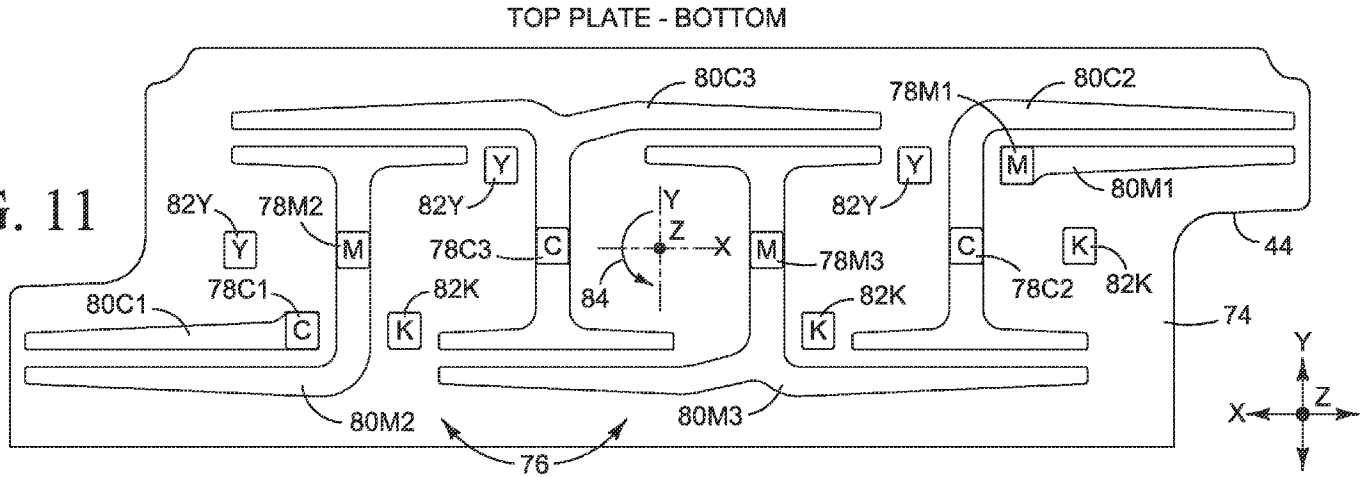

FIGS. 6-11 are top and bottom plan views of bottom plate 40 (FIGS. 6 and 7), middle plate 42 (FIGS. 8 and 9), and top plate 44 (FIGS. 10 and 11). Printing fluids enter flow structure 16 from the supply or through an intermediate delivery system at top of top plate 44, pass through a network of ports, channels and slots to the printheads at the bottom of bottom plate 40. The designations C, M, Y, K in the figures refer to cyan, magenta, yellow and black (K) ink as one example of the four printing fluids. Other printing fluids and/or combinations of printing fluids are possible. For one example, more than one of the four printing fluids could be the same type of printing fluid (e.g., black ink or white ink). Also, ink designations C, M, Y, K are used for convenience only to more clearly show the arrangement of the various flow passages.

Figure 6:
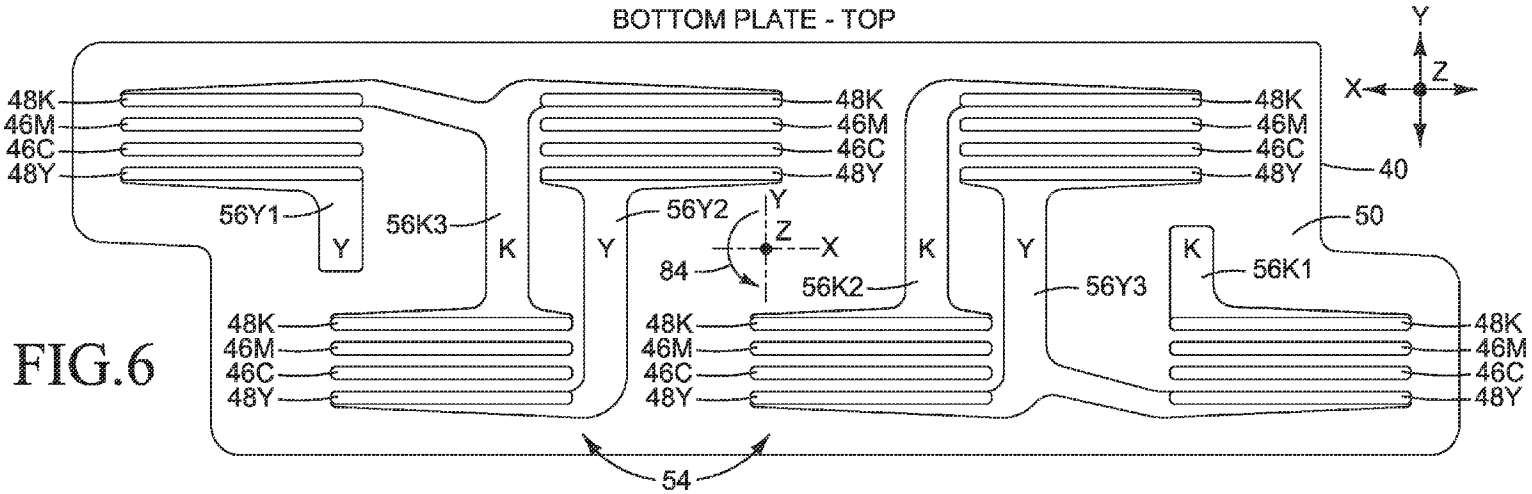
FIGS. 6 and 7 are top and bottom plan views, respectively, of the bottom plate in the printing fluid flow structure shown in FIG. 5.
Figure 7:
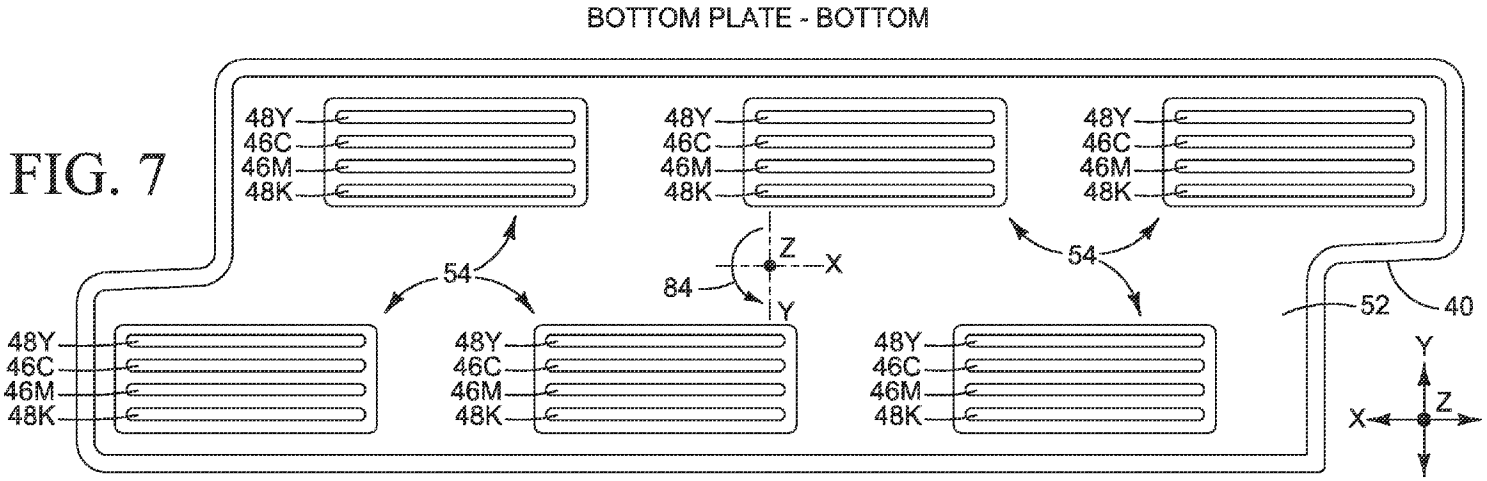

Referring first to FIGS. 6 and 7, bottom plate 40 includes a top 50 (FIG. 6), a bottom 52 (FIG. 7) and passages 54 through which printing fluid may flow through plate 40 from top 50 to bottom 52. Passages 54 include a first two groups of slots 46C, 46M through which first and second printing fluids, respectively, may flow through plate 40 from top 50 to bottom 52. Passages 54 also include two groups of channels 56Y, 56K in top 50 through which third and fourth printing fluids, respectively, may flow to a second two groups of slots 48Y, 48K in bottom 52. Each group of channels 56Y, 56K includes a first channel 56Y1, 56K1 connected to one of the slots 48Y, 48K, a second channel 56Y2, 56K2 connected to two of the slots 48Y, 48K, and a third channel 56Y3, 56K3 connected to three of the slots 48Y, 48K.

Referring to FIGS. 8 and 9, middle plate 42 includes a top 58, a bottom 60, and passages 62 through which printing fluid may flow through plate 42 from top 58 to bottom 60. Passages 62 include two groups of channels 64C, 64M in top 58 through which the first and second printing fluids, respectively, may flow to slots 66C, 66M in bottom 60. Each group of channels 64C, 64M includes a first channel 64C1, 64C2 connected to one of the slots 66C, 66M which is aligned with a corresponding slot 46C, 46M in bottom plate top 50, a second channel 64C2, 64M2 connected to two of the slots 66C, 66M which are aligned with corresponding slots 46C, 46M in bottom plate top 50, and a third channel 64C3, 64M3 connected to three of the slots 66C, 66M which are aligned with corresponding slots 46C, 46M in bottom plate top 50.

Middle plate passages 62 also include two groups of ports 68Y, 68K in top 58 through which third and fourth printing fluids, respectively, may flow to channels 70Y, 70K in bottom 60. Each group of ports 68Y, 68K includes a single first port 68Y1, 68K1 connected to a first one of the channels 70Y, 70K which is aligned with first channel 56Y1, 56Y2 in bottom plate top 50, a single second port 68Y2, 68K2 connected to a second one of the channels 70Y, 70K which is aligned with second channel 56Y2, 56K2 in bottom plate top 50, and a single third port 68Y3, 68K3 connected to a third one of the channels 70Y, 70K which is aligned with third channel 56Y3, 56K3 bottom plate top 50.

Referring to FIGS. 10 and 11, top plate 44 includes a top 72, a bottom 74, and passages 76 through which printing fluid may flow from top 72 to bottom 74. Passages 76 include a first two groups of ports 78C, 78M in top 72 through which the first and second printing fluids, respectively, may flow to channels 80C, 80M in bottom 74. Each of the first two groups of ports includes a single first port 78C1, 78M1 connected to a first one of the channels 80C1, 80M1 which is aligned with a first channel 64C1, 64M1 in middle plate top 58, a single second port 78C2, 78M2 connected to a second one of the channels 80C2, 80M2 which is aligned with a second channel 64C2, 64M2 in middle plate top 58, and a single third port 78C3, 78MC connected to a third one of the channels 80C3, 80M3 which is aligned with a third channel 64C3, 63M3 in middle plate top 58. Passages 76 also includes a second two groups of ports 82Y, 82K through which the third and fourth printing fluids, respectively, may flow through top plate 44 from top 72 to bottom 74. Each port 82Y, 82K in top plate 44 is aligned with a corresponding port 68Y1-68Y3, 68K1-68K3 in middle plate top 58.

Plates 40, 42, and 44 are assembled together to form an integrated network of ports, channels and slots in which the ports carry fluid to channels that distribute the fluid to slots that carry the fluid to the printheads. The fluid distribution channels 64C/80C, 64M/80M for the first and second printing fluids, cyan and magenta inks in this example, are formed in the bottom 74 of top plate 44 and in the top 58 of middle plate 42. Thus, the first and second printing fluids flow through one level of ports 78C, 78M to channels 64C/80C, 64M/80M where they are distributed to the printheads through three levels of slots 66C/46C, 66M/46M. By contrast, the fluid distribution channels 70Y/56Y, 70Y/56K for the third and fourth printing fluids, yellow and black in this example, are formed in the bottom 60 of middle plate 42 and in the top 50 of bottom plate 40. Thus, the third and fourth printing fluids flow through three levels of ports 82Y/68Y, 82K/68K to channels 70Y/56Y, 70Y/56K where they are distributed to the printheads through one level of slots 48Y, 48K. Accordingly, the flow path for the first and second printing fluids may be represented by the sequence P-C-C-S-S-S (port to channel to channel to slot to slot to slot) compared to P-P-P-C-C-S (port to port to port to channel to channel to slot) for the third and fourth printing fluids.

As used in this document, a "level" for each port, channel and slot means the top of a plate or the bottom of a plate.

Also, and referring to FIGS. 6-11, flow passages 54, 62, and 76 are symmetrical about a Z axis, as indicated by arrow 84, such that the arrangement of the passages on each plate 40, 42, 44 individually and collectively is the same when rotated 180° about the axis of symmetry at the geometric center of the passages. Thus, the fluid flow solution on one notched end of module 12 can be used to solve the same problem on the opposite notched end. Placing a single channel for each printing fluid at each end of the chassis to feed only one printhead helps create more space for alignment features (not shown) at the ends of the plates. Accordingly, the other channels for each printing fluid are configured to feed two and three printheads, resulting in a 1-3-2 channel arrangement for the first and second printing fluids (C, M), noted in FIG. 8, and a 1-2-3 channel arrangement for the third and fourth printing fluids (Y, K). The change in sequence from 1-3-2 on the middle plate top 58 to 1-2-3 on the middle plate bottom creates additional space for alignment features (not shown) at the center of the plates and enables adding a stiffener 86 (FIG. 4) across chassis 18.

A flow structure may distribute printing fluids to multiple printheads. The flow structure may comprise a plate, slots in the plate to carry printing fluid to the printheads, and corresponding channels in the plate to distribute printing fluid to the slots. The slots and channels may be arranged on the plate such that the arrangement is the same when rotated 180° about an axis of symmetry located at the geometric center of the arrangement In the flow structure, the channels may be formed in a top part of the plate and the slots may be formed in a bottom part of the plate.

In flow structure, the plate may include multiple plates attached to one another with the channels and slots formed at least partially in different plates.

In the flow structure, single first ones of the channels may be each connected to exactly one of the slots, single second ones of the channels may be each connected to exactly two of the slots, and single third ones of the channels may be each connected to exactly three of the slots In the flow structure, the channels may be arranged across the plate in a 1-2-3 sequence in which each of the second ones of the channels are located between the corresponding first and third ones of the channels. Alternatively, the channels may be arranged across the plate in a 1-3-2 sequence in which each of the third ones of the channels are located between the corresponding first and second ones of the channels.

Alternatively, a flow structure may distribute printing fluids to multiple printheads. The flow structure may include a plate having slots to carry printing fluid do the printheads The plate may have corresponding channels to distribute printing fluids to the slots The plate may have a first notched end. An upstream part of the plate may extend past a downstream part of the plate and a second notched end opposite the first end. The downstream part of the plate may extend past the upstream part of the plate. Single first ones of the channels may be each connected to exactly one of the slots, single second ones of the channels may be each connected to exactly two of the slots, and single third ones of the channels may be each connected to exactly three of the slots.

The channels of the flow structure may be arranged across the plate in a 1-2-3 sequence in which each of the second ones of the channels are located between the corresponding first and third ones of the channels. Alternatively, the channels may be arranged across the plate in a 1-3-2 sequence in which each of the third ones of the channels are located between the corresponding first and second ones of the channels.

In another example, a flow structure may distribute printing fluids to multiple printheads. The flow structure may include a first plate having a top, a bottom and first and second notched ends where one part of the plate extends past another part. The flow structure may also include a second plate having a top, a bottom and first and second notched ends where one part of the plate extends past another part. The top of the second plate may be attached to the bottom of the first plate such that the notched ends are aligned on both plates. The flow structure may include a first group of channels in the top of the first plate. A first one of the channels in the first group may distribute a first printing fluid to exactly one opening in the bottom of the first plate aligned with a corresponding opening in the second plate and extend into a protruding part at the first notched end the first plate. A second one of the channels in the first group may distribute the first printing fluid to exactly two openings in the bottom of the first plate aligned with corresponding openings in the second plate. A third one of the channels in the first group may distribute the first printing fluid to exactly three openings in the bottom of the first plate aligned with corresponding openings in the second plate.

The flow structure may also include a second group of channels in the top of the first plate. A first one of the channels in the second group may distribute a second printing fluid to exactly one opening in the bottom of the first plate aligned with a corresponding opening in the second plate and extend into the protruding part at the second notched end of the plate. A second one of the channels in the second group may distribute the second printing fluid to exactly two openings in the bottom of the first plate aligned with corresponding openings in the second plate. A third one of the channels in the second group may distribute the second printing fluid to exactly three openings in the bottom of the first plate aligned with corresponding openings in the second plate.

The flow structure may also include a third group of channels in the top of the second plate. A first one of the channels in the third group may distribute a third printing fluid to exactly one opening in the bottom of the second plate and extend into the protruding part at the first notched end of the second plate. A second one of the channels in the third group may distribute the third printing fluid to exactly two openings in the bottom of the second plate. A third one of the channels in the third group may distribute the third printing fluid to exactly three openings in the bottom of the second plate.

The flow may also include a fourth group of channels in the top of the second plate. A first one of the channels in the fourth group may distribute a fourth printing fluid to exactly one opening in the bottom of the second plate and extend into the protruding part at the second notched end of the second plate. A second one of the channels in the fourth group may distribute the fourth printing fluid to exactly two openings in the bottom of the second plate. A third one of the channels in the fourth group may distribute the fourth printing fluid to exactly three openings in the bottom of the second plate.

In the flow structure, each of the openings may be a slot.

In another example, a print bar, may include multiple interchangeable printhead assembly modules stacked end to end with a part of each module overlapping a part of an adjacent module.

In the print bar, an upstream row of printheads on each module may be aligned with an upstream row of printheads on each of the other modules. Further, a downstream row of printheads on each module may be aligned with a downstream row of printheads on each of the other modules. Additionally, a printhead in the upstream row of each module may overlap a printhead in the downstream row of an adjacent module.

In the print bar, each module may include multiple printheads supported by a chassis having an upstream part supporting the upstream row of printheads and a downstream part supporting the downstream row of printheads parallel to the upstream row. The upstream and downstream rows of printheads may be offset from one another such that a printhead in the upstream row extends past the downstream part of the chassis at one end of the module and a printhead in the downstream row extends past the upstream part of the chassis at the other end of the module.

In the print bar, each module may include a flow structure to distribute printing fluid to the printheads, the flow structure may be supported by the chassis over the printheads.

In the print bar, the flow structure may include a plate. Slots in the plate may carry printing fluid to the printheads, and corresponding channels in the plate may distribute printing fluid to the slots. The slots and channels may be arranged on the plate such that the arrangement is the same when rotated 180° about an axis of symmetry located at the geometric center of the arrangement.

In the print bar, the channels may be formed in a top part of the plate and the slots may be formed in a bottom part of the plate.

In the print bar, the plate may include multiple plates attached to one another with the channels and slots formed at least partially in different plates.

In the print bar, single first ones of the channels may be each connected to exactly one of the slots, single second ones of the channels may be each connected to exactly two of the slots, and single third ones of the channels may be each connected to exactly three of the slots.

What is claimed is:

1. A printhead assembly module, comprising:

multiple printheads;

a flow structure to distribute printing fluid to the printheads; and a chassis supporting the printheads and the flow structure, the chassis stackable end to end with other printhead assembly module chassis such that the chassis of one module overlaps the chassis of an adjacent module when the chassis are stacked end to end, wherein the flow structure includes a plate, slots in the plate to carry printing fluid to the printheads, and corresponding channels in the plate to distribute printing fluid to the slots, the slots and channels arranged on the plate such that the arrangement is the same when rotated 180° about an axis of symmetry located at the geometric center of the arrangement, wherein the channels are formed in a top part of the plate and the slots are formed in a bottom part of the plate, wherein the plate includes multiple plates attached to one another with the channels and slots formed at least partially in different plates, and wherein single first ones of the channels are each connected to exactly one of the slots, single second ones of the channels are each connected to exactly two of the slots, and single third ones of the channels are each connected to exactly three of the slots.

2. The printhead assembly module of claim 1, wherein:

the chassis includes an upstream part supporting an upstream row of printheads and a downstream part supporting a downstream row of printheads parallel to the upstream row; and the upstream and downstream rows of printheads are offset from one another such that a printhead in the upstream row extends past the downstream part of the chassis at one end of the module and a printhead in the downstream row extends past the upstream part of the chassis at the other end of the module.

3. A printhead assembly module, comprising:

multiple printheads;

a flow structure to distribute printing fluid to the printheads; and a chassis supporting the printheads and the flow structure, the chassis including: a first notched end where an upstream part of the chassis extends past a downstream part of the chassis; a second notched end opposite the first end where a downstream part of the chassis extends past an upstream part of the chassis; the upstream part of the chassis supporting an upstream row of the printheads; the downstream part of the chassis supporting a downstream row of the printheads parallel to the upstream row; and a printhead in the upstream row extends past the downstream part of the chassis at the first end of the chassis and a printhead in the downstream row extends past the upstream part of the chassis at the second end of the chassis, wherein the flow structure includes a plate, slots in the plate to carry printing fluid to the printheads, and corresponding channels in the plate to distribute printing fluid to the slots, wherein the plate includes a bottom plate near the printheads, a top plate, and a middle plate sandwich between the top plate and the bottom plate, and wherein the bottom plate has a top and a bottom and passages through which printing fluid may flow from the top to the bottom, the passages in the bottom plate including:

a first two groups of slots through which first and second printing fluids, respectively, may flow through the bottom plate from top to bottom; and two groups of channels in the top through which third and fourth printing fluids, respectively, may flow to a second two groups of slots in the bottom, each group of channels including a first channel connected to exactly one of the slots, a second channel connected to exactly two of the slots, and a third channel connected to exactly three of the slots.

4. The printhead assembly module of claim 3, wherein the middle plate has a top and a bottom and passages through which printing fluid may flow from the top In the bottom, the passages in the middle plate including;

two groups of channels in the top through which the first and second printing fluids, respectively, may flow to slots in the bottom, each group of channels including a first channel connected to exactly one of the slots which is aligned with a corresponding slot in the top of the bottom plate, a second channel connected to exactly two of the slots which are aligned with corresponding slots in the top of the bottom plate, and a third channel connected to exactly three of the slots which are aligned with corresponding slots in the top of the bottom plate; and two groups of ports in the top through which third and fourth printing fluids, respectively, may flow to channels in the bottom, each group of ports including a single first port connected to a first one of the channels which is aligned with the first channel in the top of the bottom plate, a single second port connected to a second one of the channels which is aligned with the second channel in the top of the bottom plate, and a single third port connected to a third one of the channels which is aligned with the third channel in the top of the bottom plate.

5. The printhead assembly module of claim 4, wherein the top plate has a top and a bottom and passages through which printing fluid may flow from the top to the bottom, the passages including:

a first two groups of ports in the top through which the first and second printing fluids, respectively, may flow to channels in the bottom, each of the first two groups of ports including a single first port connected to a first one of the channels which is aligned with the first channel in the middle plate top, a single second port connected to a second one of the channels which is aligned with the second channel in the middle plate top, and a single third port connected to a third one of the channels which is aligned with the third channel in the middle plate top; and a second two groups of ports through which the third and fourth printing fluids, respectively, may flow through the top plate from top to bottom, each the ports in the second two groups aligned with a corresponding port in the middle plate top.

* * * * *